US006151906A

United States Patent [19]

da Silva

[11] Patent Number: 6,151,906

[45] Date of Patent: Nov. 28, 2000

[54] CONDENSATE COLLECTION SYSTEM FOR A ROOM AIR CONDITIONER

[75] Inventor: Regis Batista da Silva, Sao Leopoldo, Brazil

[73] Assignee: Carrier Corporation, Syracuse, N.Y.

[21] Appl. No.: 09/367,584

[22] PCT Filed: Dec. 30, 1997

[86] PCT No.: PCT/BR97/00075

§ 371 Date: Aug. 17, 1999

§ 102(e) Date: Aug. 17, 1999

[87] PCT Pub. No.: WO99/35450

PCT Pub. Date: Jul. 15, 1999

[51] Int. Cl.[7] ..... F23B 47/00

[52] U.S. Cl. ..... 62/279; 62/285

[58] Field of Search ..... 62/279, 285, 298

[56] References Cited

U.S. PATENT DOCUMENTS

| | | | |
|---|---|---|---|
| 3,724,233 | 4/1973 | Pugh et al. | 62/285 |
| 5,437,164 | 8/1995 | Consiglio | 62/259.1 |
| 5,669,230 | 9/1997 | Bruce et al. | 62/285 |

*Primary Examiner*—William Doerrler
*Assistant Examiner*—Melvin Jones

[57] ABSTRACT

According to the present invention, an air conditioning unit is provided which includes an indoor section and an outdoor section, which are supported by a basepan and which are separated by a partition forming part of the basepan. The indoor section includes an indoor fan and an evaporator coil. During operation, the cold evaporator condenses water from the air being cooled and the condensate flows downwardly to the lower end of the evaporator where it is collected and a flow path is provided from the indoor section through the partition to the outdoor section. The lower end of the evaporator is supported by a substantially horizontal support surface. A condensate collection channel has a first portion located adjacent to, substantially parallel to and in fluid communication with the horizontal support surface. The first portion of the condensate collection channel is inclined from a high point at one end thereof to a low point at the other end thereof. The condensate collection channel has a second portion in fluid flow communication with the other end of the first portion. The second portion is inclined from a high point where it is in flow communication with the first portion to a low point in the outdoor section of the air conditioner.

5 Claims, 7 Drawing Sheets

CONDENSATE COLLECTION SYSTEM FOR A ROOM AIR CONDITIONER

TECHNICAL FIELD

This invention relates generally to air conditioning systems and, more particularly, it relates to room air conditioners wherein moisture removed from inside air is conducted to the outside section of the unit.

BACKGROUND ART

Warm air is frequently humid, i.e. it contains entrained water vapor. During operation of an air conditioning system in a cooling mode, the system evaporator reduces the temperature of the air passing through it to below the dew point. In that condition, water vapor condenses on the evaporator. Means must be provided to dispose of this condensate. In small unitary air conditioners, such as room air conditioners, a common means to accomplish condensate disposal is to provide a condensate collection and drain path that communicates between the inside section and the outside section of the air conditioner.

DISCLOSURE OF THE INVENTION

According to the present invention, an air conditioning unit is provided which includes an indoor section and an outdoor section, which are supported by a basepan and which are separated by a partition forming part of the basepan. The indoor section includes an indoor fan and an evaporator coil. During operation, the cold evaporator condenses water from the air being cooled and the condensate flows downwardly to the lower end of the evaporator where it is collected and a flow path is provided from the indoor section through the partition to the outdoor section. The lower end of the evaporator is supported by a substantially horizontal support surface. A condensate collection channel has a first portion located adjacent to, substantially parallel to and in fluid communication with the horizontal support surface. The first portion of the condensate collection channel is inclined from a high point at one end thereof to a low point at the other end thereof. The condensate collection channel has a second portion in fluid flow communication with the other end of the first portion. The second portion is inclined from a high point where it is in flow communication with the first portion to a low point in the outdoor section of the air conditioner.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
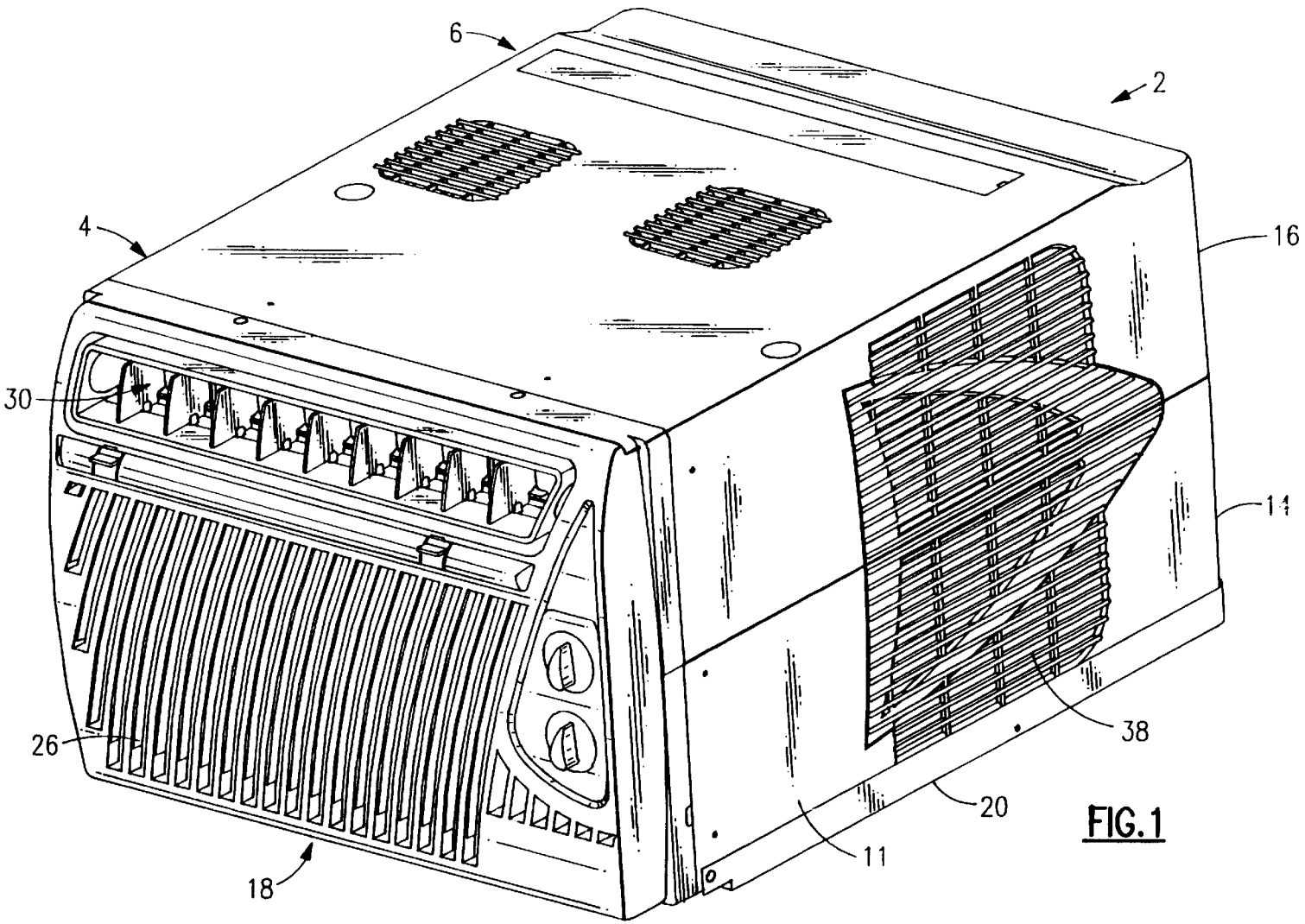
FIG. 1 is an perspective view of a room air conditioner which embodies the features of this invention.

With reference initially to FIG. 1, an air conditioner 2 includes generally an indoor section 4 and an outdoor section 6. The air conditioning unit 2, includes a substantially rectangular housing 12 which includes a lower housing section 14, an upper housing section 16, and an indoor grill section 18. The lower housing section 14 is mounted in a metal support pan 20, and the entire room air conditioner is adapted to be positioned in a rectangular opening in an exterior wall or on a windowsill in a room where cooling is desired, with the indoor grill section 18 facing into the room as is conventional.

The housing section 12 and 14 and the grill 18 are preferably made from a molded plastic material. As best seen in FIGS. 2 through 6, the entire air conditioning unit 2 is supported on a basepan 8 molded integrally with and forming the bottom of the lower housing 14. Extending upwardly from the basepan, and integrally formed with left and right sidewalls 10 and 11 respectively, is a vertically extending partition 13 which separates the indoor 4 and outdoor 6 sections.

Figure 2:
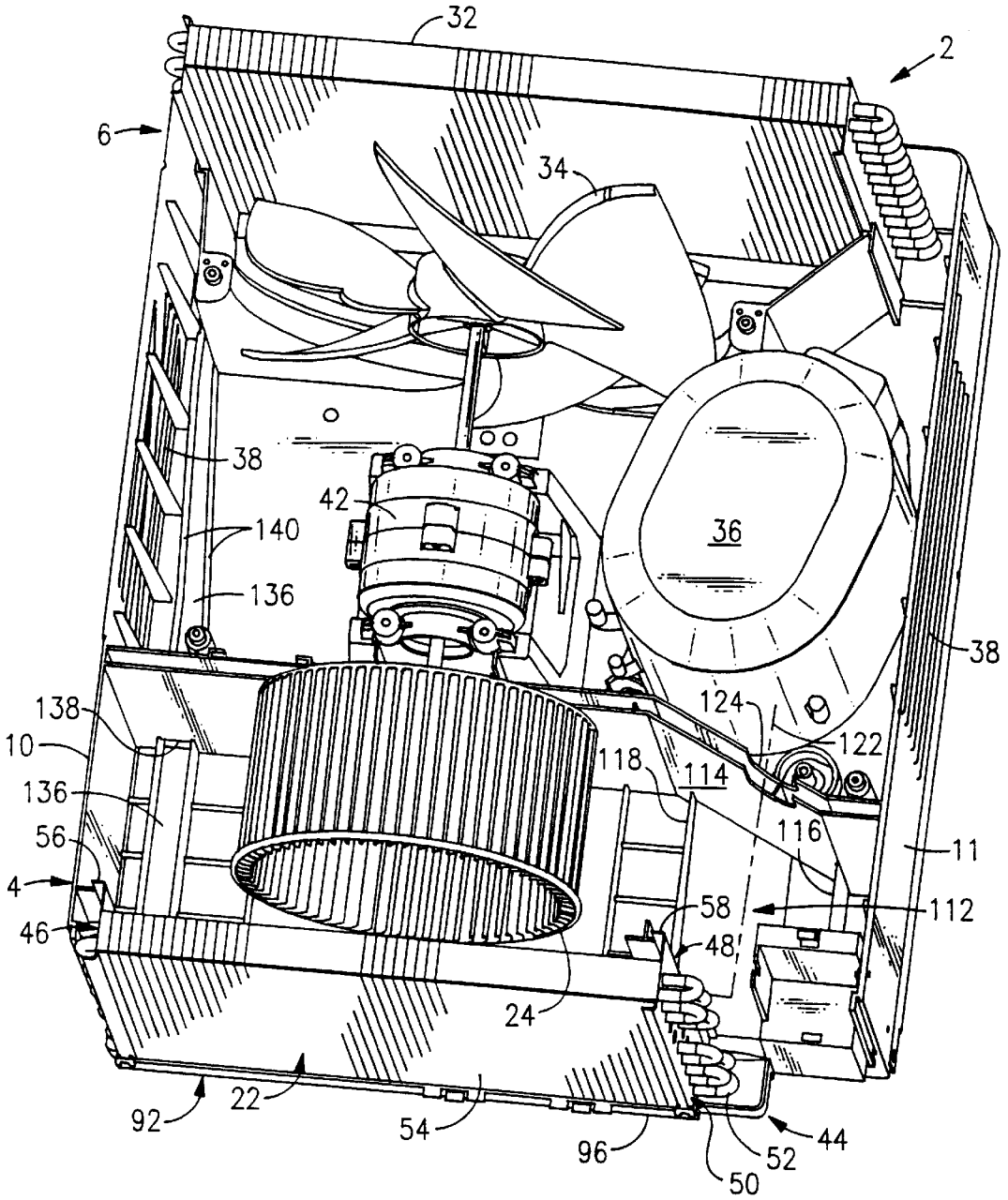
FIG. 2 is a perspective view of the air conditioner of FIG. 1 with the upper cover, front grill portions and other selected components removed therefrom.

FIG. 2 illustrates the unit 2 with the upper housing section 16 and the indoor grill section 18 removed. Again, as is conventional, the unit comprises an indoor refrigerant to air heat exchanger 22 (hereinafter "evaporator coil") and an inside or evaporator fan 24. Air from the space to be conditioned by the system is drawn by action of the evaporator fan 24, through inlet louvers 26 formed in the indoor grill section 18 and is directed through the evaporator coil 22 where the air is cooled. The cooled air is then directed back into the space to be cooled by a scroll assembly 28, which, in turn, directs the air through an indoor conditioned air discharge assembly 30 forming part of the grill 18.

Figure 4:
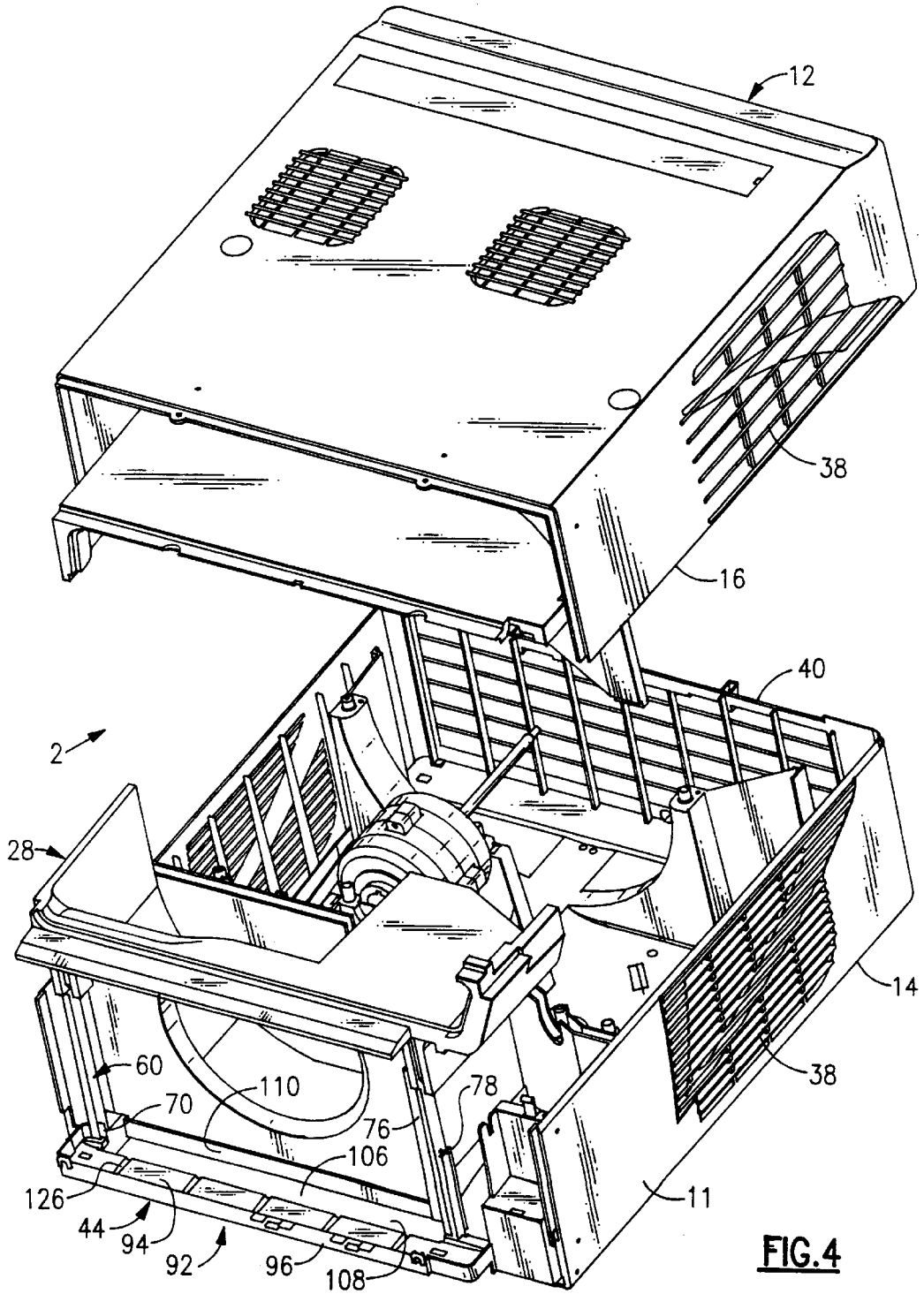
FIG. 4 is a partially exploded perspective view of the air conditioner of FIG. 1 with certain components removed therefrom.

It should be noted that the scroll assembly 28 is shown only in FIG. 4. In a fully assembled unit, the evaporator fan 24 is located within the scroll to cause the above-described air flow. The scroll has been removed from the other drawing Figures in order to clearly show the details of the condensate collection system of the present invention.

With continued reference to FIG. 2, the unit also includes, as is conventional, an outdoor refrigerant to air heat exchanger or coil 32 (hereinafter "condenser coil 32"), a condenser fan 34 and a compressor 36. In operation, ambient air enters the housing 12 through a number of louvered air inlets 38 located in the top and sides of the housing sections 14 and 16. The air entering the inlets 38 is then drawn through the outdoor fan 34 and is directed through the condenser coil 32 before exiting through discharge openings 40 in the back of the housing 12. As is best seen in FIG. 2, both the evaporator fan 24 and the condenser fan 34 are driven from opposite ends of a single drive shaft of a common drive motor 42 mounted in the outside section 6 of the housing 12.

Figure 3:
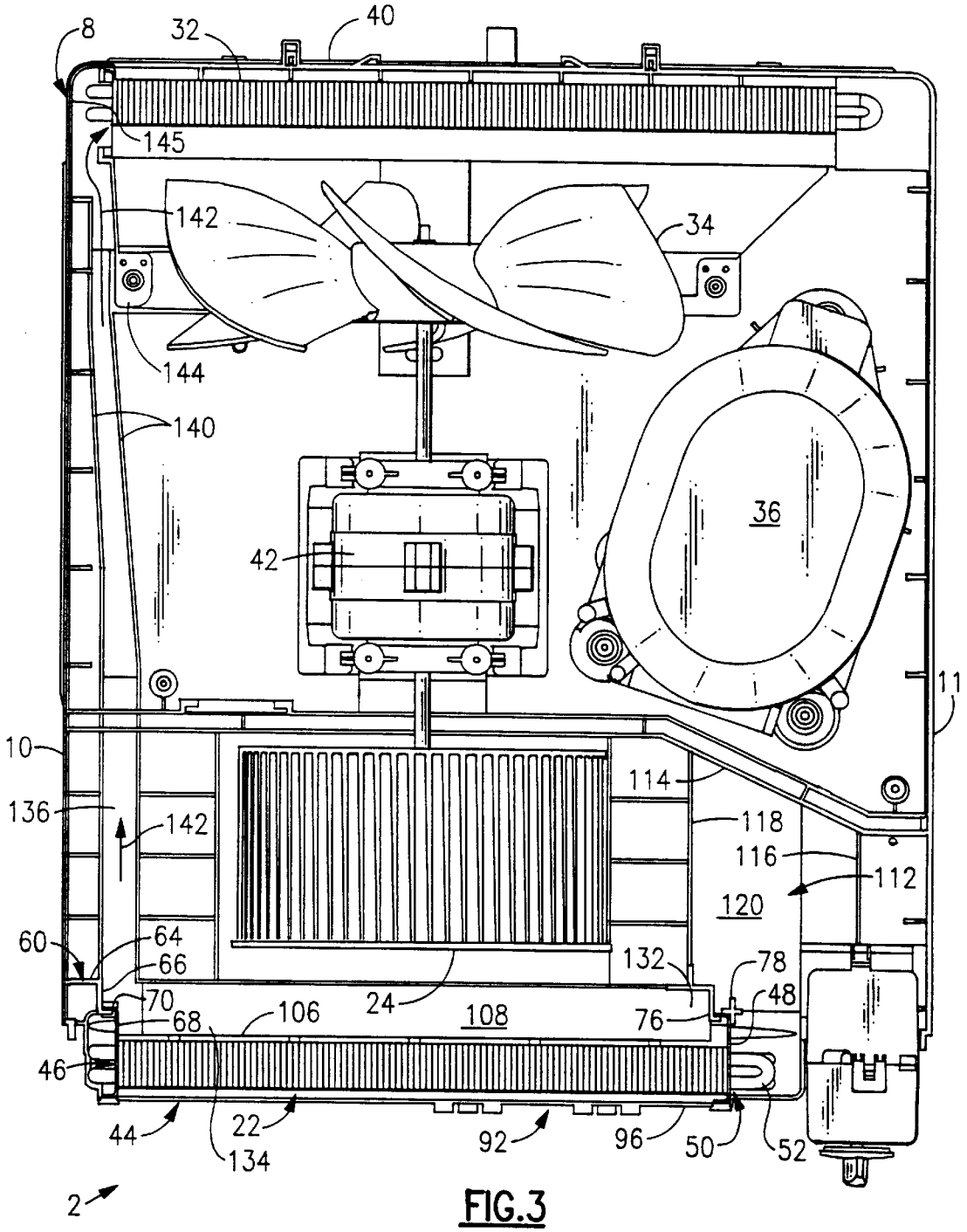
FIG. 3 is a top elevational view of the air conditioner of FIG. 1 with the upper housing and other components removed therefrom.
Figure 3A:
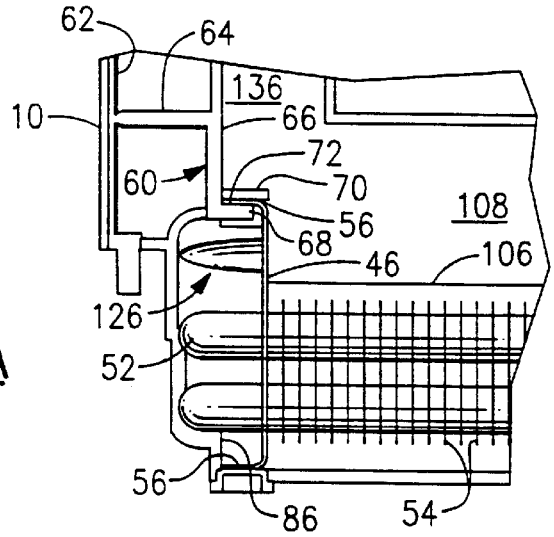
FIG. 3A is an enlarged view of the left front section of FIG. 3.
Figure 3B:
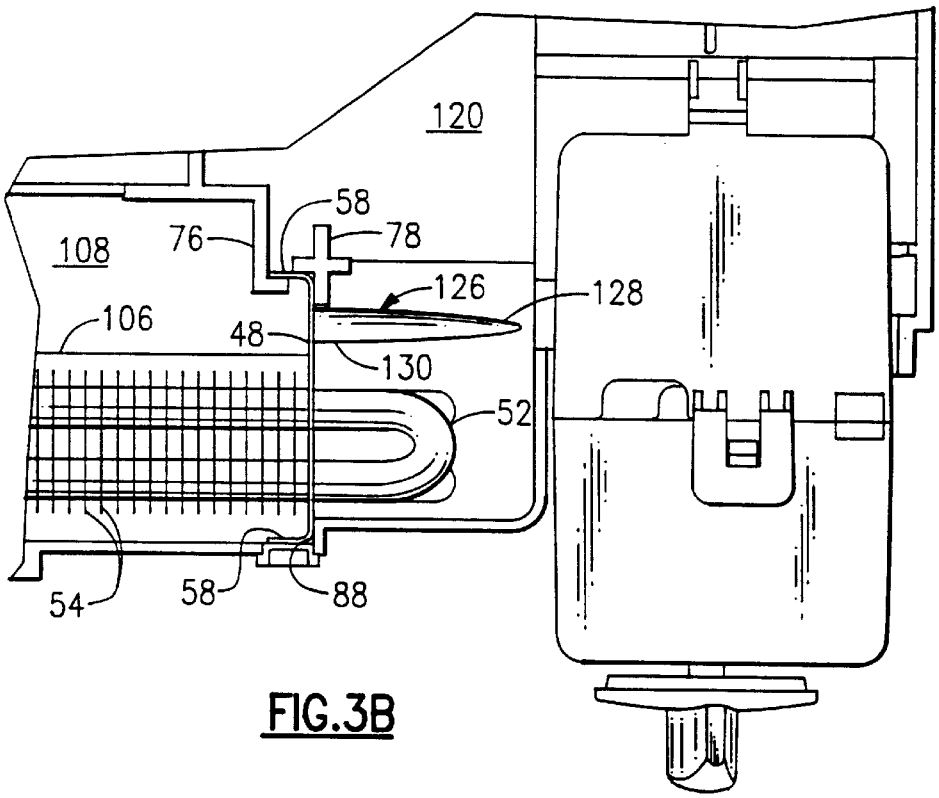
FIG. 3B is an enlarged view of the right front section of FIG. 3.

Looking now at FIGS. 3, 3A and 3B, a top view of the evaporator coil 22, as supported in the front end 44 of the basepan 8 of lower housing section 14 is illustrated. The evaporator coil 22 includes a left-hand tube sheet 46 and a right-hand tube sheet 48. As is conventional, two rows of heat exchanger tubes 50 interconnected by hairpin turn ends 52 extend between the tube sheets to define a continuous flow path for refrigerant therethrough. A plurality of vertically extending heat exchange fins 54 are carried by the tubes and extend substantially vertically and parallel to the tube sheets 46 and 48.

Figure 5:
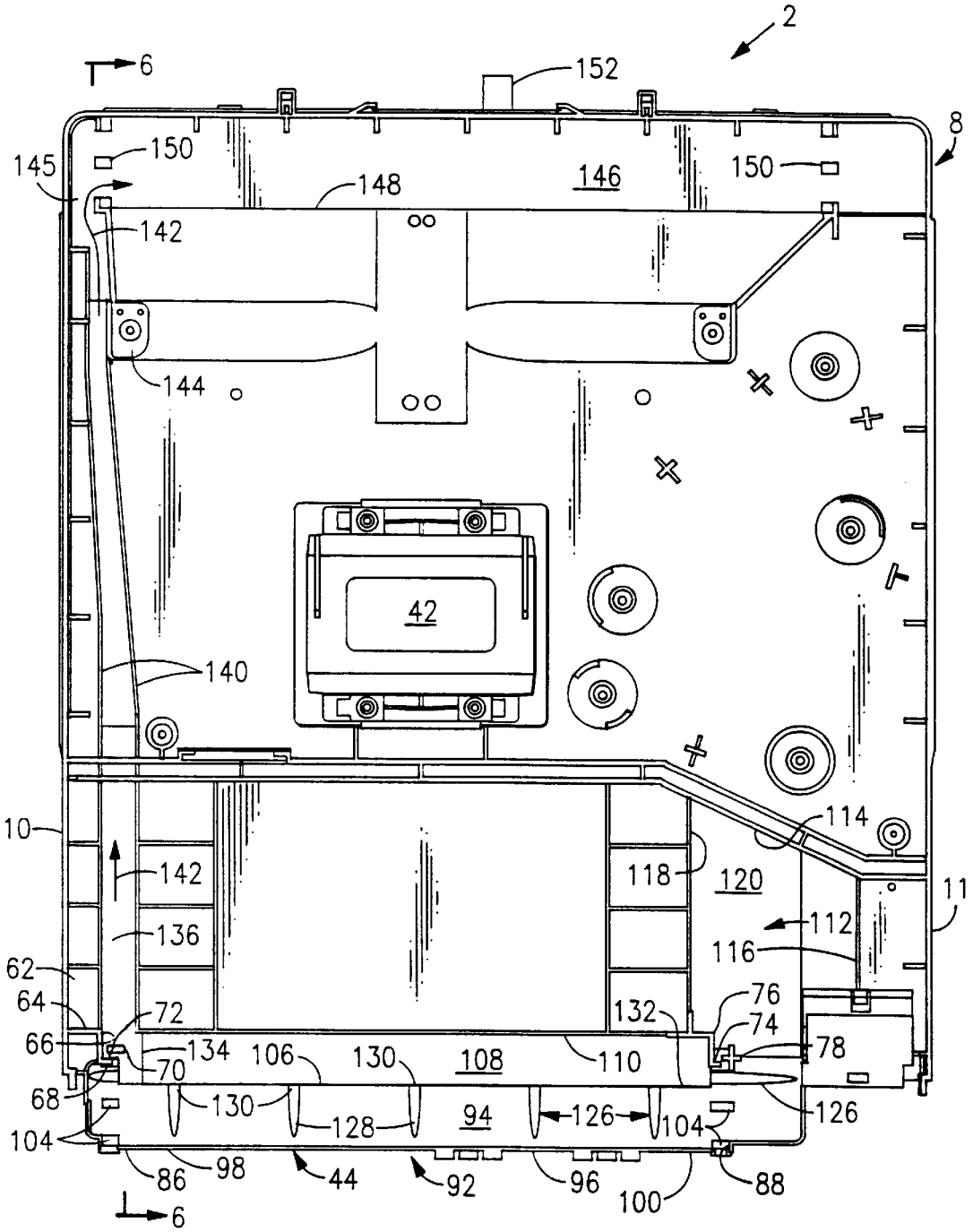
FIG. 5 is a top plan view of the lower housing and basepan of the air conditioner of FIG. 1 with many of the components removed.
Figure 6:
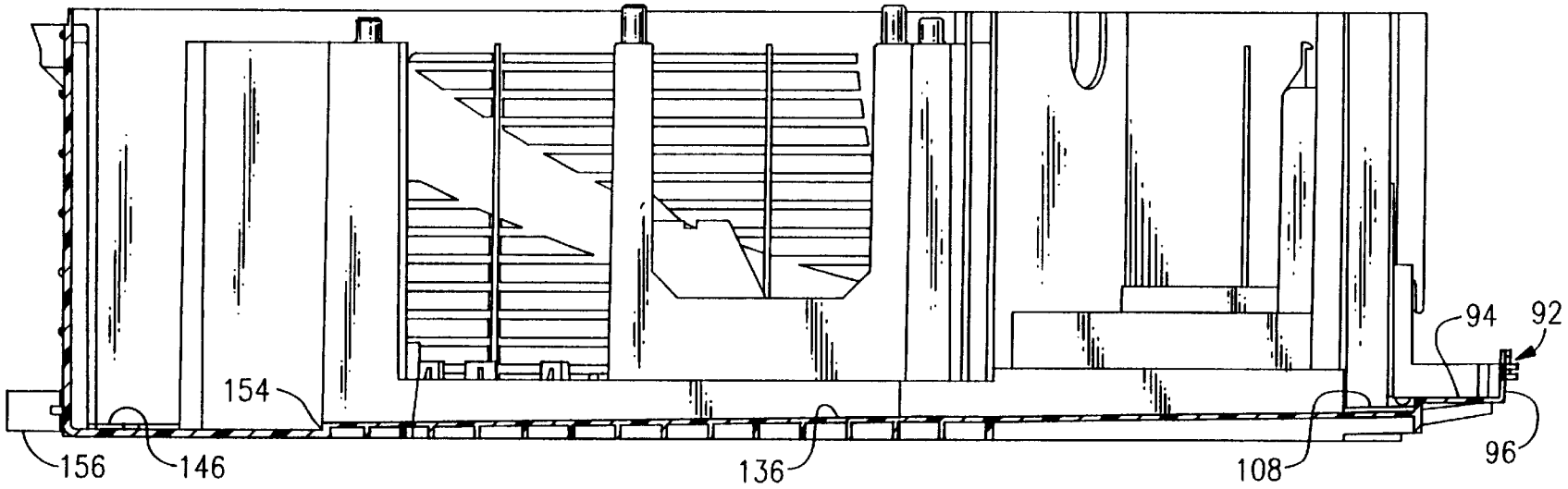
FIG. 6 is a sectional view taken along the lines 6—6 of FIG. 5.

Support of the evaporator coil 22 will now be described in connection with FIGS. 2 through 6. FIGS. 4, 5 and 6 illustrate the unit with the evaporator coil 22 and many other components removed in order to illustrate the support structure, the condensate collection system, and the condensate drain path.

Each of the tube sheets 46 and 48 has an elongated U-shaped cross section with short legs 56 and 58, respectively, extending to the left as viewed in the drawing figures. Looking first at the support for the left-hand tube sheet 46 and with particular reference to FIG. 3A, a vertically extending support channel 60 is integrally molded into the basepan and the inside of the left wall 10 of the lower housing section 14. The channel 60 comprises a first section 64 formed integrally with the wall 110 and extending substantially parallel to the evaporator coil 22. A second section 66 extends perpendicular to and forwardly of the first section 64 and a third shorter section 68 extends to the right and substantially parallel to the evaporator coil 22. Extending from the right of the lower end of the second section 66 is a short wall section 70 which is spaced from the third wall section 68 by a distance substantially equal to the thickness of the rear leg 58 of the tube sheet 48. Accordingly, the rear leg 58 of the tube sheet 48 is adapted to engage the rearwardly facing surface 72 of the third channel section 68 and to be received within the space defined between that surface and the short wall section 70.

Looking now at FIG. 3B, the rear leg 58 of the right hand tube sheet 48 is adapted to engage a rearwardly facing surface 74 defined by a vertically extending channel 76 having a cross section substantially identical to that of the channel 60 described in detail for support of the left-hand tube sheet 46. The channel 76 on the right-hand side is molded into the basepan of the lower housing section 14. As with the left-hand tube sheet, the rear leg 58 of the right hand tube sheet is adapted to engage the rear surface 72 of the channel 60. Unlike the left-hand tube sheet, however, support of the right-hand tube sheet is provided in both a lateral and front-to-rear position by a vertically extending substantially cross-shaped section 78, which is adapted to engage both the rearwardly facing surface of the rear leg 58 as well as the right-hand facing planar surface of the right-hand tube sheet 48.

Further positioning of the evaporator coil 22 is provided by engagement of the front leg 56 of the left-hand tube sheet 46 with a right-hand facing wall 86 molded into the front of the lower housing section 14. In a similar fashion, a left-hand facing wall molded into the front of the lower housing section 14 is adapted to engage the right-hand facing wall of the right-hand tube sheet 48.

As best shown in FIG. 2, the lower ends of the tube sheets 46 and 48 of the evaporator coil 22 are supported by a condensate drain pan 92 formed at the front end of the basepan 8 of the lower housing section 14. The condensate drain pan 92 is defined by a lower horizontal surface 94 which serves to support the lower ends of the tube sheets and a vertically extending perimeter wall section 96. The perimeter wall 96 includes short outwardly extending sections 98 and 100 at the left and right-hand sides thereof and an elongated section 102 which interconnects the short sections 98 and 100. It will be noted that the tube sheet supporting walls 86 and 88 described above are formed in the elongated wall section 102.

As best seen in FIGS. 4 and 5, the horizontal surface 94 of the condensate drain pan 92 is provided with a plurality of small upstanding support pads 104 at both the left and right-hand ends thereof immediately underlying the lower ends of the left and right tube sheets 46 and 48. When the evaporator coil is installed as described above, the lower ends of the tube sheets 46 and 48 engage the pads 104. As a result, the tube sheets and, accordingly, the lower ends of the heat exchange fins 54 of the coil are supported such that they are spaced from the horizontal surface 94.

The horizontal surface 94 terminates at a rear edge 106, which provides a transition to a condensate collection channel 108. The condensate collection channel 108 is defined at its right-hand end in part by the vertically extending tube sheet support channel 76, rearwardly by a vertically extending wall 110 molded into the basepan 8, and, at its left-hand end in part by the vertically extending tube sheet support channel 60.

As been shown in FIGS. 2, 3 and 5, the basepan 8 is further provided with a confined condensate collection region 112 lying to the right of and rearwardly of the right-hand end of the evaporator coil 22. The condensate collection region 112 is defined at its backside by an angularly positioned section 114 of the partition 13 and at its right and left-hand sides by vertically extending wall sections 116 and 118, respectively. The lower surface 120 of the condensate collection region 112 is at substantially the same elevation as the horizontal surface 94 of the condensate drain pan at the front end thereof and rises to a higher elevation at its intersection with the partition section 114.

As shown diagramically in FIG. 2, refrigerant tubes 122 extend from the right-hand side of the evaporator coil 22 through an opening 124 in the partition wall 13 to the compressor and condenser coil in the outdoor section. The tubes 122 directly overlie the condensate collection region 112 described above. During operation of the air conditioning unit, particularly during high humidity conditions, condensate may form on the refrigerant tubes 122. Such condensate will drip from the tubes and be captured in the condensate collection region 112 from where it will flow to the horizontal surface 94 of the condensate drain pan 92 and thence into the condensate collector channel 108.

Looking now at FIGS. 4, 5 and 6, it will be seen that a plurality of small tapered channels 126 are provided in the horizontal surface 94 which transition from a shallow depth near the outer edge of the condensate drain pan 92 to a maximum depth at their ends 130 at the rear edge 106 where they are in fluid flow communication with the condensate collection channel 108. These channels encourage flow of condensate from the surface 94 and the collection region 112 into the channel 108.

Accordingly, during operation of the air conditioning unit, condensate from the condensate collection region 112 as well as condensate running downwardly from the evaporator coil 22 will be conducted through the tapered channels 126 to the condensate collector channel 108. The condensate collection channel 108 in turn is inclined from a higher elevation at its right-hand end 132 to a lower elevation at its left-hand end 134. This results in gravity flow of condensate from right to left as viewed in FIGS. 2 through 5.

The left-hand end of the condensate collection channel 108 communicates with a second condensate collection channel 136 at the left-hand end thereof, as best seen in FIGS. 3, 4 and 5. The second condensate collector channel 136 is defined by a pair of upstanding substantially parallel walls 138 formed in the basepan 8. The channel 136 passes through an opening 138 in the partition wall and extends into the outdoor section 6 along the path as indicated by the arrows 142.

As best shown in FIGS. 3 and 5, the channel 136 extends to the left of an upstanding wall 144 which forms a part of the outdoor fan shroud to a horizontally extending region 146 in the back of the lower housing section 14, which supports the condenser coil 32 of the air conditioning unit. A vertically extending wall section 148 defines the front of the condenser support surface 146 and extends across the entire width of the basepan 8 except for the opening 145 where the second condensate collection 136 passes in fluid communication with the condenser support surface 146.

The condenser support surface 146 is provided with a plurality of raised support pads 150 at the left and right-hand ends thereof, which serve to support the condenser coil 32 at an elevation slightly above the condenser support surface 146. A centrally located opening 152 is provided in the back wall of the lower housing section 14 to provide a drain path for excess condensate which may collect on the condenser support surface, as is conventional.

In a manner similar to the first condensate collection channel 108, the second condensate collection channel 136 transitions from a common elevation with the left-hand side of the first condensate collection channel to a lower elevation at the back of the housing 14 where it communicates with the condenser support surface.

As best seen in FIG. 6, the channel 136 has a downward step 154 formed therein at a location just behind the fan shroud wall 144. The step 154 serves to prevent back flow in the channel 136 of condensate or any rainwater that may collect in the outdoor section. As a result, it should be appreciated that the condensate collection path, which begins at the condensate collection region 112, at its highest elevation, is continuously pitched downwardly through the first condensate collection channel 108 and the second condensate collection channel 136 to the condenser support surface 146 to thereby assure flow of collected condensate from the front of the air conditioning unit to the rear of the unit for disposal.

Free flow of condensate from the evaporator coil to the rear of the unit and disposal thereof is further facilitated by the mounting of both the evaporator coil and the condenser coil on the raised pads 104 and 150, respectively, described above. This arrangement as well as the tapered channels 126 serve to break any surface tension in the water and encourage free flow of the condensate.

I claim:

1. A room air conditioner of the type having an indoor section and an outdoor section, which are supported by a base pan and are separated in part by a partition, the indoor section includes an indoor fan and an evaporator coil, the cold evaporator condenses water from the air being cooled, the condensate flows downwardly to the lower end of the evaporator where it is collected and a flow path is provided from the indoor section, through the partition to the outdoor section;

wherein the improvement comprises:

a substantially horizontal surface for supporting the lower end of said evaporator;

a condensate collection channel having a first portion thereof located adjacent to, substantially parallel to, and in fluid communication with said horizontal surface, said first portion of said condensate collection channel being inclined from a high point at one end thereof to a low point at the end thereof, said condensate collection channel having a second portion in fluid flow communication with said other end of said first portion, said second portion being inclined from a high point where it is in flow communication with said first portion to a low point in said outdoor section.

2. The apparatus of claim 1 further including:

refrigerant tubes extending from said evaporator coil, through said partition to said outdoor section; and said housing further including a condensate collection region underlying said refrigerant tubes, said condensate collection region being in fluid communication with said one end of said first portion of said condensate collection channel, said condensate collection being inclined from a high point adjacent said partition to a low point where it is in fluid communication with said first portion of said condensate collection channel.

3. The apparatus of claim 1 wherein said substantially horizontal surface is provided with a plurality of tapered channels therein, each of said channel extending from a high point on said horizontal surface to a lower point where it is in fluid communication with said first portion of said condensate collection channel.

4. The apparatus of claim 1 wherein said second portion of said condensate channel has a step therein that provides a transition from a high point nearest to said indoor section to a low point rearwardly in said outdoor section.

5. The apparatus of claim 1 wherein the left and right end of said substantially horizontal surface are each provided with at least one upstanding protuberance thereon adapted to engage the lower end of said evaporator coil and support it in spaced relation from said horizontal surface.

* * * * *